US006568236B2

(12) United States Patent
Kondo et al.

(10) Patent No.: US 6,568,236 B2
(45) Date of Patent: May 27, 2003

(54) RIVET SETTING MACHINE

(75) Inventors: Yoshiteru Kondo, Toyohashi (JP); Yoshiaki Suzuki, Toyohashi (JP)

(73) Assignee: Newfrey LLC, Newark, DE (US)

( * ) Notice: Subject to any disclaimer, the term of this patent is extended or adjusted under 35 U.S.C. 154(b) by 18 days.

(21) Appl. No.: 09/876,605

(22) Filed: Jun. 7, 2001

(65) Prior Publication Data

US 2002/0014102 A1 Feb. 7, 2002

(30) Foreign Application Priority Data

Jun. 14, 2000 (JP) ..... 2000-177806

(51) Int. Cl.[7] ..... B21J 15/30

(52) U.S. Cl. ..... 72/448; 72/453.19

(58) Field of Search ..... 29/243.53, 243.54; 72/448, 453.17, 453.19; 100/231, 249

(56) References Cited

U.S. PATENT DOCUMENTS 530,162 A * 12/1894 Cuenot ..... 72/448
2,360,991 A * 10/1944 Ward et al. ..... 72/448
5,771,551 A * 6/1998 Schurter et al. ..... 29/243.54

FOREIGN PATENT DOCUMENTS

AU 647927 * 12/1992 ..... 72/448

* cited by examiner

*Primary Examiner*—Lowell A. Larson
(74) *Attorney, Agent, or Firm*—Harness, Dickey & Pierce, P.L.C.

(57) ABSTRACT

A rivet setting machine is provided that includes a movable die supporting member that operates to increase working space when inserting and removing workpieces during non-fastening operations. In a first position, the die supporting member positions a die in an opposed relationship to a punch. In a second position, the die supporting member positions the die at a position apart from the punch, which increases the distance between the die and the punch during non-fastening operations.

40 Claims, 6 Drawing Sheets

RIVET SETTING MACHINE

FIELD OF THE INVENTION

The present invention relates generally to rivet setting machines and more particularly to self-piercing rivet setting machines for connecting two or more panel members (or a panel and a component), for example, in an automobile assembly operation.

BACKGROUND OF THE INVENTION

Rivet setting machines are widely used in a variety of applications to attach two or more components or workpieces together such as aluminum panels in automobile assemblies. More specifically, self-piercing rivet setting machines are preferably employed to connect workpieces without penetrating or piercing interior surfaces thereof in order to improve sealing performance. Generally, a self-piercing rivet is deformed into the workpieces using a punch and die combination, wherein an annular edge of the rivet shank is deformed into and along with the workpieces that are fastened together.

One example of a self-piercing rivet is disclosed in U.S. Pat. No. 5,752,305 to Cotterill et al. (corresponding to Japanese Patent Laid-Open No. 08-505087). The self-piercing rivet, as illustrated in FIG. 1, comprises a flange-shaped head and a pair of legs extending downward from the head. When the rivet is driven into workpieces, e.g. a pair of automobile body panels, by use of a punch and a die, the legs are deformed to spread out their front ends while piercing the panels, and thus the panels are connected to each other by the spreadingly deformed legs and the head. The self-piercing rivet is suitable for connecting aluminum body panels to which welding processes are not applied. Since the aluminum bodies are increasingly employed to provide weight reduction in automobile bodies, the demand for the self-piercing rivet would similarly increase.

A rivet setting machine of the known art that installs self-piercing rivets is disclosed in EP 0 893 179 B1 to Mauer et al., (corresponding to Japanese Patent Laid-Open No. 11-90575). As shown in FIG. 2, the self-piercing rivet setting machine comprises a C-shaped frame including a horizontal upper arm, a vertical arm and a horizontal lower arm. The machine further comprises a punch movably mounted on one end (the end of the horizontal upper arm) of the C-shaped frame and formed to hold the self-piercing rivet. Additionally, a die is disposed at the other end (the end of the horizontal lower arm) of the C-shaped frame to receive the self-piercing rivet that is held in the punch. Furthermore, the machine comprises a drive means, such as a motor, for pressing the punch against the die to urge the self-piercing rivet against the die, whereby a plurality of workpieces placed between the punch and the die are fastened together. Particularly, in the self-piercing rivet setting machines described in the known art, the legs of the self-piercing rivet are adapted to connect the workpieces to each other without penetrating or piercing the workpieces so that high sealing performance to the interior of the automobile can be advantageously maintained.

Self-piercing rivet setting machines usually include the C-shaped frame comprising the horizontal upper arm, the vertical arm, and the horizontal lower arm. Further, the C-shaped frame is formed in a one-piece unit to withstand the loads induced when fastening the rivet to the workpieces. Thus, when the rivet setting machine is not operated, the distance between the punch mounted on the one end (e.g. the end of the horizontal upper arm) and the die disposed at the other end (e.g. the end of the horizontal lower arm) is arranged to be constant and is therefore limited due to the size of the C-shaped frame. If the workpieces are simple flat plates, the workpieces are positioned relatively easily between the punch and the die.

However, if a workpiece has a standing wall protruding at a right angle therefrom, it may be impossible to position the workpiece between the punch and the die. In such a case, it is necessary to change the C-shaped frame with a larger one in order to increase the distance between the punch and the die, however, a large C-shaped frame that has a sufficient stiffness to withstand the loads leads to a larger rivet setting machine as a whole. Further, in conjunction with an upper limit in the stroke of the punch of the rivet setting machine, it is impractical to change the drive unit and other related parts. As a result, some workpieces have not been able to be fastened together due to their large shape and complex configurations.

Accordingly, there remains a need in the art for a rivet setting machine that can accommodate larger and more complicated workpieces without removing and replacing features, such as a C-shaped frame, of the rivet setting machine. The rivet setting machine should further be capable of accommodating larger and more complicated workpieces at high production rates.

SUMMARY OF THE INVENTION

In accordance with the present invention, a rivet setting machine includes a die supporting member that is movably mounted to a frame. The die supporting member holds a die in a first position, wherein the die is placed in an opposed relationship to a punch during fastening operations. The die supporting member further holds the die in a second position, wherein the die is placed at a position apart from the punch, thereby increasing the distance between the die and the punch during non-fastening operations. As a result, additional working space is provided for inserting and removing larger and more complicated workpieces.

In one form, the die supporting member is movably mounted to the frame using a pin. Accordingly, the die supporting member is pivoted about the pin between the first and second positions. In another aspect of the present invention, the die supporting member is automatically pivoted using a rod extending from a drive unit. The drive unit is mounted to the frame, and the rod is attached to the die supporting member such that the drive unit operates to retract and extend the rod, thereby pivoting the die supporting member about the pin between the first position and the second position. In yet another form, the die supporting member is movably mounted to the frame using a rail.

The present invention is advantageous over conventional devices since the distance between the punch and the die of the present invention is increased even further to accommodate even larger and more complicated workpieces. In addition, the die supporting member similarly includes a positioning guide that properly positions the die in the first position during fastening operations. Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
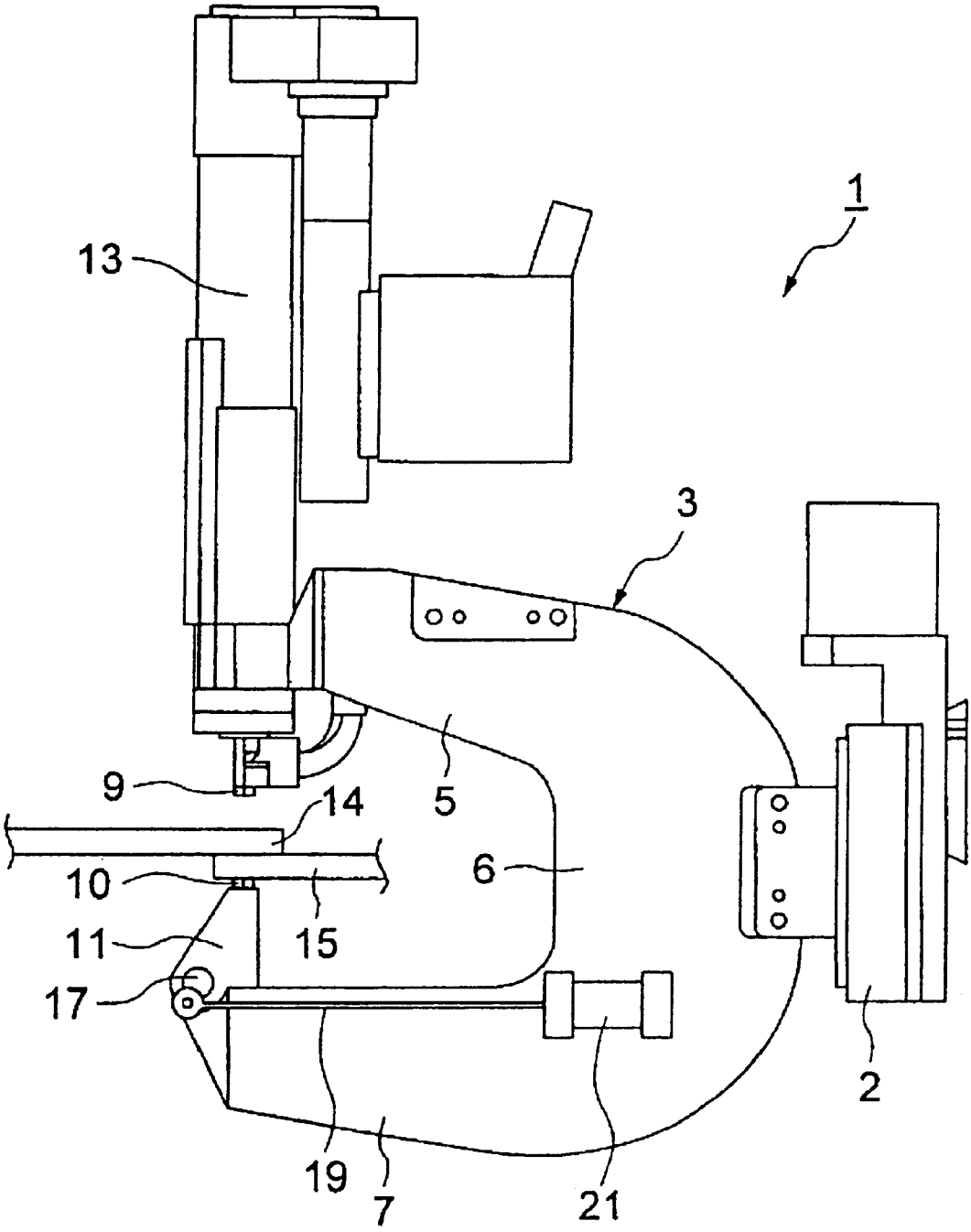
FIG. 1 is a side view of a self-piercing rivet setting machine with a die supporting member in the first position in accordance with a first embodiment of the present invention.
Figure 2:
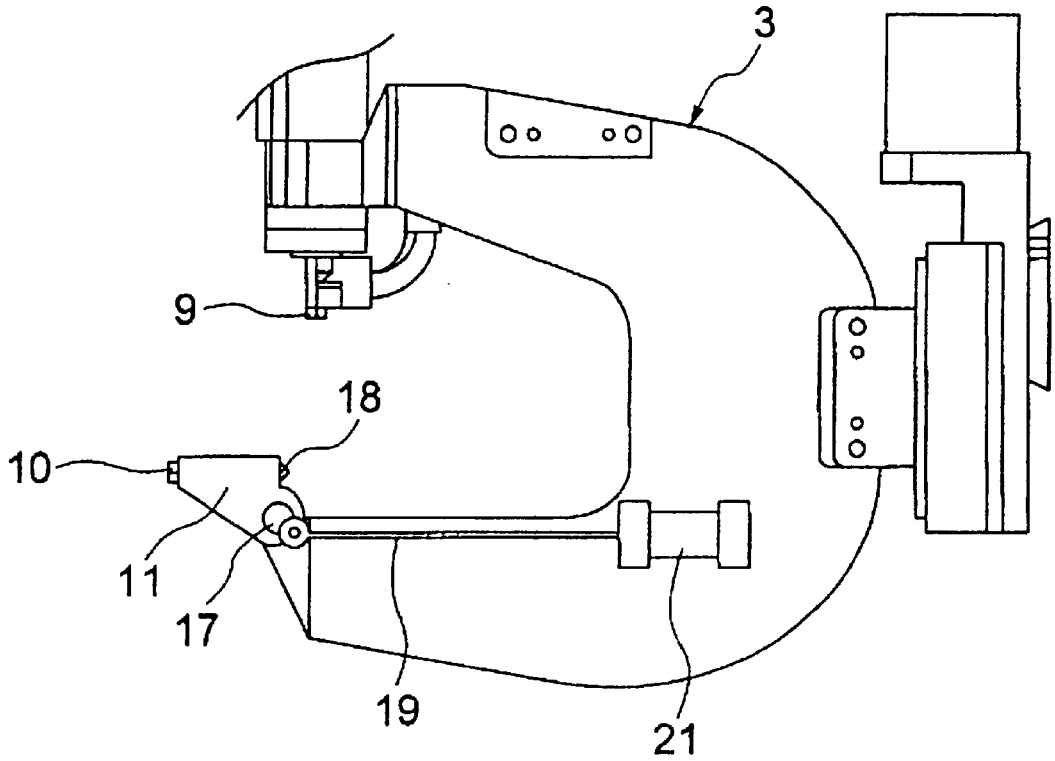
FIG. 2 is a side view of a self-piercing rivet setting machine with a die supporting member in the second position in accordance with the first embodiment of the present invention.

FIGS. 1 and 2 shows a first preferred embodiment of the self-piercing rivet setting machine according to the present invention. In FIG. 1, the self-piercing rivet setting machine 1 includes a C-shaped frame 3 having a connecting section 2 connected with an articulated robot arm (not shown). The C-shaped frame 3 is formed in a rigid body integrated with a horizontal upper arm 5, a vertical arm 6 having the connecting section 2 mounted thereon, and a horizontal arm 7. A punch 9, adapted to hold a self-piercing rivet (not shown), is mounted on one end of the C-frame 3, such as the end of the horizontal upper arm 5, so as to vertically move during a fastening operation for workpieces. A die 10 is disposed at the other end of the C-shaped frame 3, such as the end of the horizontal lower arm 7, to receive a pair of legs of the self-piercing rivet held by the punch 9. In the present invention, the die 10 is fixed to a die supporting member 11 mounted on the end of the horizontal lower arm 7 of the C-shaped frame 3.

The self-piercing rivet setting machine 1 further includes a drive unit 13 for pressing the punch 9 against the die 10 to strongly urge against the die the self-piercing rivet held by the punch 9. For example, the drive unit 13 comprises an electric motor, a belt for transmitting the rotating force of the motor, and a lead screw vertically moving while rotating by the rotating force from the belt. The lead screw is moved downward according to the rotation of the motor, and then this motion is transmitted to the punch 9 to strongly urge against the die 10 the self-piercing rivet held by the punch. The punch 9 may be moved back by reversing the motor. The self-piercing rivet is automatically fed to the front end of the punch 9. The punch 9 is provided with a mechanism for holding the fed self-piercing rivet in an adequate timing. A pair of workpieces 14 and 15 are placed on the die 10, and the pair of workpieces are connected to each other by inserting the self-piercing rivet while piercing the pair of workpieces 14 and 15 by the self-piercing rivet based on the downward movement of the punch 9.

As shown in FIGS. 1 and 2, in the present invention, the die 10 is supported by the supporting member 11, and this die supporting member 11 is mounted on the horizontal lower arm 7 of the C-shaped frame 3. In the embodiment of FIGS. 1 and 2, the die supporting member 11 is mounted on the end of the horizontal lower arm 7 of the C-shaped frame 3 to pivotably move about a pin 17 horizontally extending in an orthogonal manner to the horizontal lower arm 7. The die supporting member 11 is adapted to be pivoted over the range of about 90 degrees between a first position (a vertically standing position of FIG. 1), in which the die 10 is placed in the opposed relationship to the punch 9, and a second position (a horizontally lying position of FIG. 2), in which the die 10 is placed in a space extending from the end of the lower arm 7 of the C-shaped frame 3. A positioning guide 18 is provided at the bottom of the die supporting member in the cooperative relationship with a depression (not shown) in the horizontal lower arm 7 to allow the die 10 to be positioned in a suitable manner for receiving the pressure from the punch 9, particularly, at the first position (the vertically standing position of FIG. 1). Further, the bottom surface of the die supporting member 11 and the top surface of the horizontal lower arm 7 are finely finished with a high degree of accuracy to maintain the aforementioned positioning.

A rod 19 is attached to the die supporting member 11 at another position different from that of the pin 17. This rod 19 extends from a drive unit 21, such as a solenoid, fixed to either the horizontal lower arm 7 or the vertical arm 6 of the C-shaped frame 3. When the drive unit 21 operates to extend and retract the rod 19, the rod 19 moves in a crank motion to pivot the die supporting member 11 about the pin 17 between the first position (the vertically standing position) and the second position (the horizontally lying position). Thus, the die supporting member 11 can be pivoted or swung to selectively take either one of the first position (the vertically standing position of FIG. 1) and the second position (the horizontally lying position of FIG. 2) by the operation of the drive unit 21.

As shown in FIG. 1, the die 10 is fixedly placed to the position opposed to the punch 9 (the first position) during the fastening operation. Thus, the distance between the punch 9 and the die 10 becomes narrow. On the other hand, as shown in FIG. 2, during a non-fastening operation, such as an operation for placing the workpiece, the die supporting member 11 can be pivoted to the second position to allow the die 10 to be placed at the position apart from the punch 9 (the second position) to increase the distance between the die 10 and the punch 9, by operating the drive unit 21. This second position sufficiently provides a wide space between the punch 9 and the die 10. Thus, even if a workpiece has a standing wall-shaped portion, the workpiece may be positioned between the die and the punch to perform the fastening operation as-is without using a large C-shaped frame.

In an exemplary executed test, a conventional machine had the distance between the die and the punch of about 100 mm. On the other hand, the rivet setting machine of the present invention could reliably achieve the distance of 150 mm. When the workpiece had the standing wall-shaped portion, the die supporting member 11 was pivoted or swung to the second position of FIG. 2, and then the standing wall portion was placed in the C-shaped frame 3, followed by pivoting the die supporting member 11 to the first position of FIG. 1. The action of the positioning guide 18 and the shapes of both the die supporting member 11 and the lower arm 7 allowed the die 10 to be returned to the first position to be suitably aligned with the punch 9 to provide a desirable fastening operation.

Figure 3:
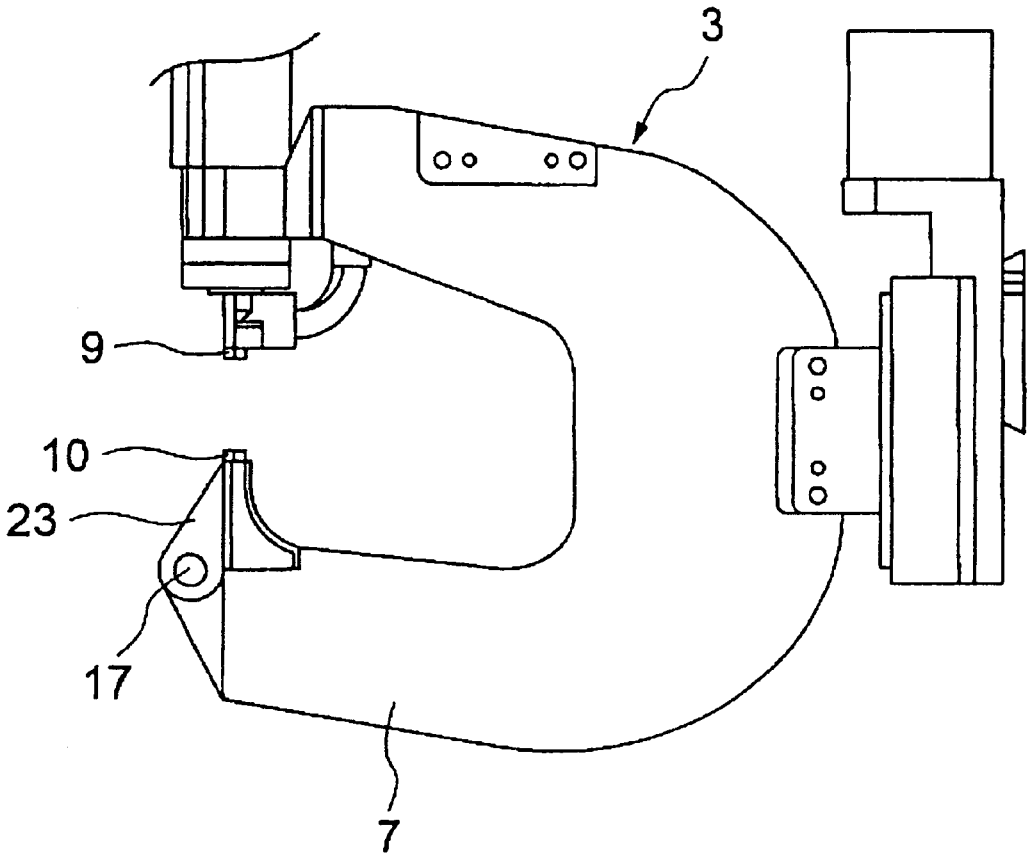
FIG. 3 is a side view of a self-piercing rivet setting machine with a die supporting member in the first position in accordance with a second embodiment of the present invention.
Figure 4:
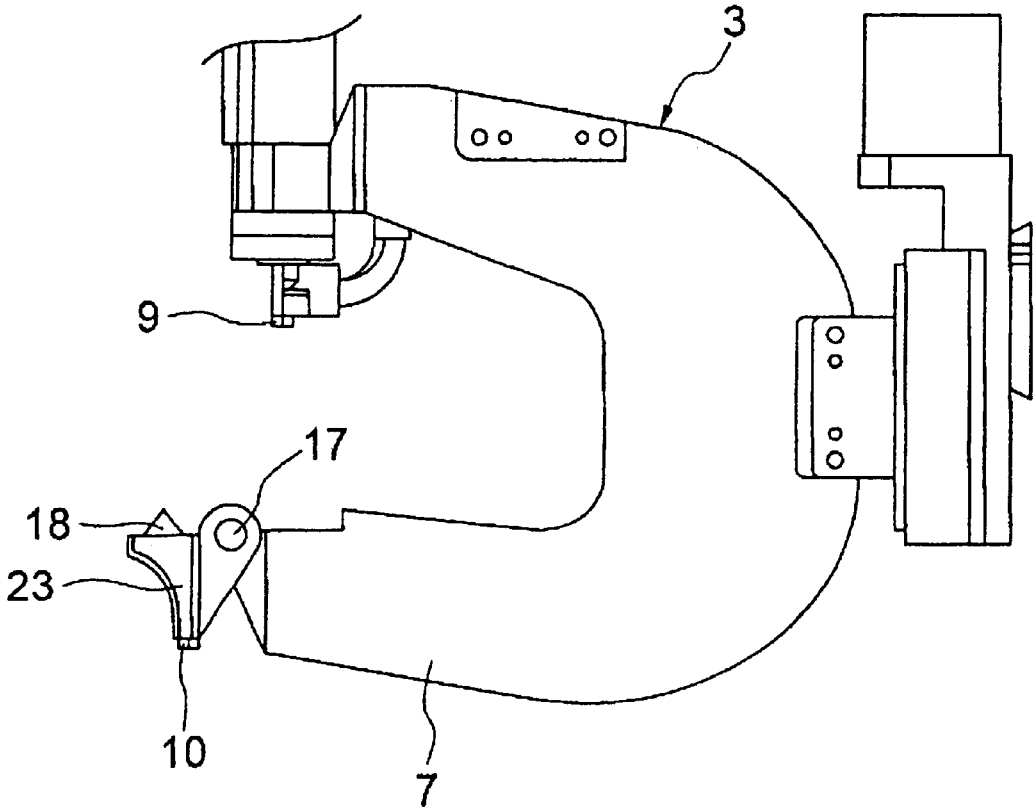
FIG. 4 is a side view of a self-piercing rivet setting machine with a die supporting member in the second position in accordance with the second embodiment of the present invention.

FIGS. 3 and 4 show a second preferred embodiment of the self-piercing rivet setting machine according to the present invention. In this embodiment, a die supporting member 23 is connected with the pin 17 horizontally extending in an orthogonal orientation to the horizontal lower arm 7 of the C-shaped frame 3 to pivotably move between a first position (a vertical upward-facing position of FIG. 3), in which the die 10 is placed in the opposed relationship to the punch 9, and a second position (a vertical downward-facing position of FIG. 4), in which the die 10 is pivoted or swung by 180 degrees from the first position about the end of the lower arm 7. Since other constructions are the same as those of the self-piercing rivet setting machine 1 according to the first embodiment shown in FIGS. 1 and 2, their explanation will be omitted.

While no drive unit is shown in the die supporting member 23, a suitable drive unit may be provided to allow the die supporting member to be pivoted by 180 degrees. The positioning guide 18 is also provided on the bottom surface of the die supporting member 23 in the cooperative relationship with the depression (not shown) of the arm 7. Further, the bottom surface of the die supporting member 23 and the top surface of the horizontal lower arm 7 are formed to allow the die to be adequately positioned. This 180 degrees pivoting can provide a wider space between the punch 9 and the die 10. Thus, it is not necessary to use a large C-shaped frame even if a workpiece has a high standing wall-shaped portion.

Figure 5:
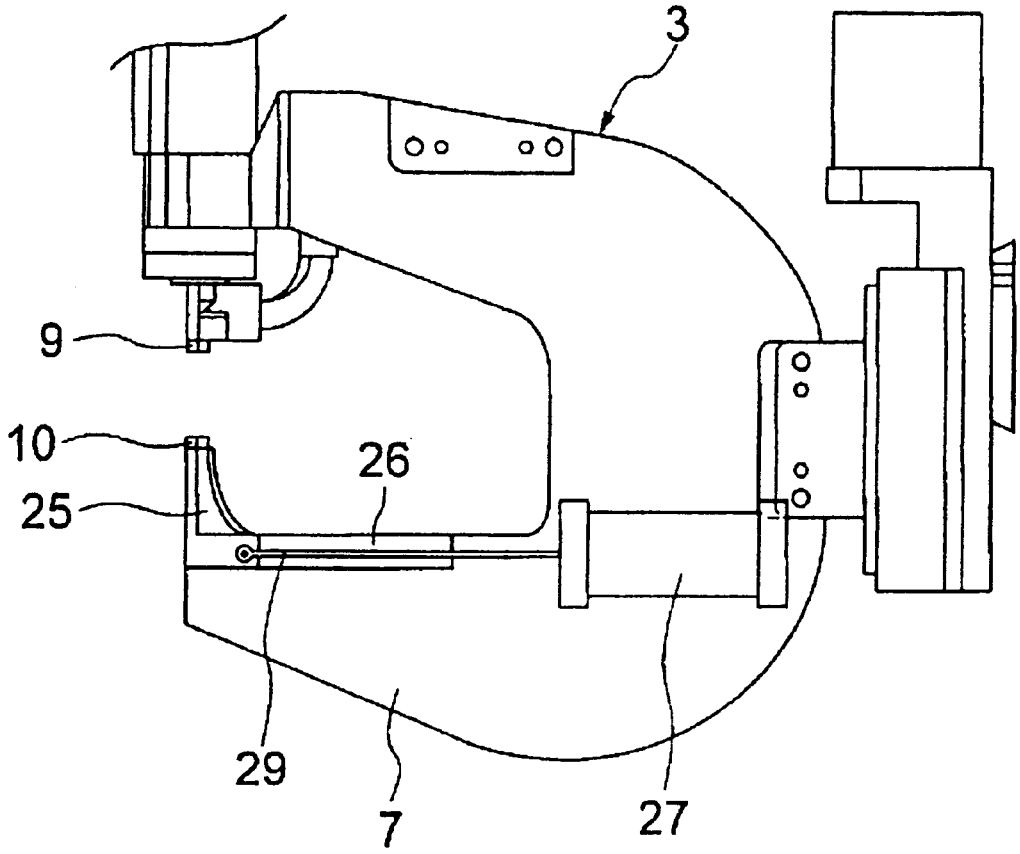
FIG. 5 is a side view of a self-piercing rivet setting machine with a die supporting member in the first position in accordance with a third embodiment of the present invention.
Figure 6:
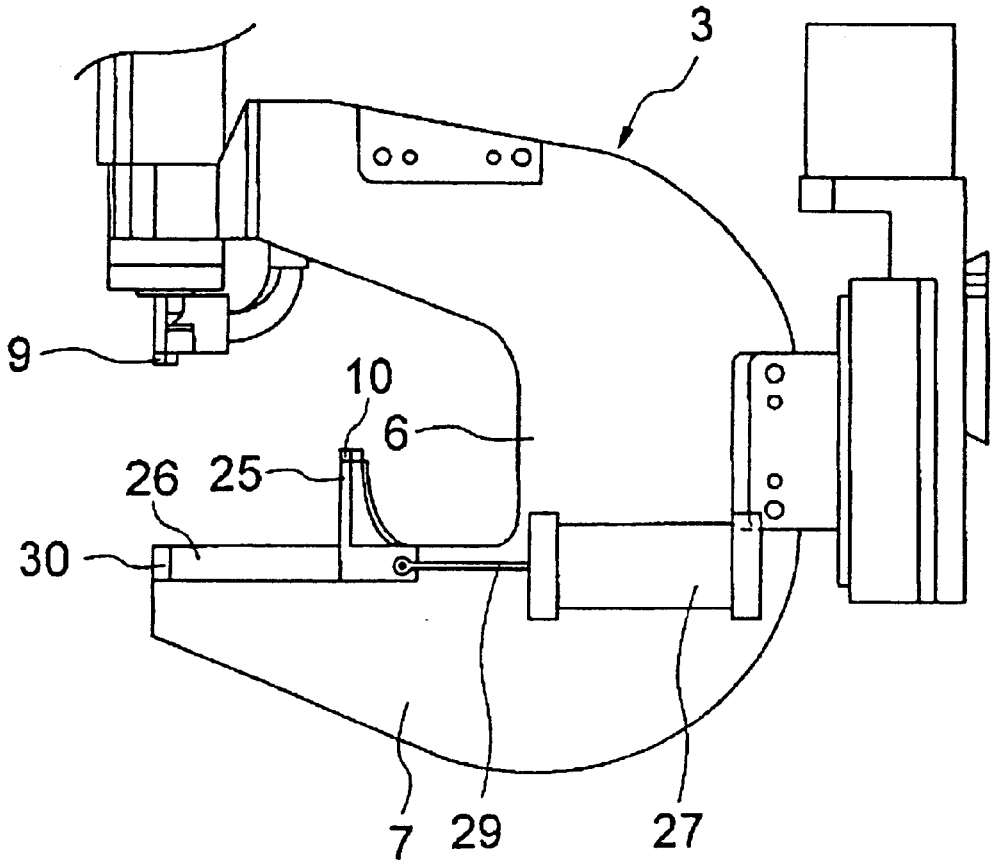
FIG. 6 is a side view of a self-piercing rivet setting machine with a die supporting member in the second position in accordance with the third embodiment of the present invention.

FIGS. 5 and 6 show a third preferred embodiment of the self-piercing rivet setting machine according to the present invention. In this third embodiment, a die supporting member 25 is mounted on the lower arm 7 of the C-shaped frame 3 to slidably move on a rail 26 provided along the lower arm 7. Thus, the die supporting member 25 can be moved between a first position (or an extended position of FIG. 1), in which the die 10 is placed in the opposed relationship to the punch 9, and a second position (or a retracted position of FIG. 2), in which the die 10 is placed close to the vertical arm 6 of the C-shaped frame. A rod 29 extends from a drive unit 27, such as a solenoid, and the rod is attached to the die supporting member 25 to selectively move the die supporting member 25 between the first position of FIG. 5 and the second position of FIG. 6. In the third embodiment, the rail 26, mounted on the lower arm 7, is provided with a positioning guide 30 (see FIG. 6) at the end of the rail 26 facing the punch 9. This allows the die 10 to be reliably aligned with the punch 9 in the opposed relationship. Since other constructions are the same as those of the self-piercing rivet setting machine 1 according to the first embodiment shown in FIGS. 1 and 2, their explanation will be omitted.

As shown in FIG. 5, the die supporting member 25 is fixedly placed at the first position in which the die 10 is placed in the opposed relationship to the punch 9 by means of the positioning guide 30, during the fastening operation. During a non-fastening operation, such as an operation for placing the workpiece, the die supporting member 25 is slid to the second position of FIG. 6 in order to move away from the punch 9 and increase the distance between the die 10 and the punch 9. This movement occurs by operating the drive unit 27. This second position can provide a sufficiently wide distance between the punch 9 and the die 10 such that even if a workpiece has a standing wall-shaped portion, the workpiece can be positioned between the die and the punch without using a large C-shaped frame. When a workpiece has a standing wall-shaped portion, the die supporting member 25 is moved to the second position of FIG. 2 and then the standing wall parts are placed into the C-shaped frame 3. Subsequently, the entire C-shaped frame 3 is moved slightly downward to assure a space for moving the die supporting member 25 while not disturbing the return movement of the die supporting member 25. Then the die supporting member 25 is slid to the first position of FIG. 1 by operating the drive unit 27. The action of parts including the positioning guide 30, allow the die 10 to be returned to the first position and to be adequately aligned with the punch 9 for providing a desirable fastening operation. The surface in contact with the C-shaped frame of the die supporting member is positioned in an orthogonal orientation to the pressure or load from the punch. This allows the C-shaped frame to withstand the pressure from the punch, i.e. the load caused by fastening the rivet, as much as 5 tons.

As described above, according to the present invention, while the die is placed in the opposed relationship to the punch during the fastening operation, the die can be placed apart from the punch to increase the distance to the punch during non-fastening operation. Thus, even if a workpiece has a standing wall-shaped portion, the workpiece may be positioned between the die and the punch to perform the fastening operation as-is without using a large C-shaped frame. The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. A rivet setting machine comprising:

a frame;

at least one punch movably mounted to the frame, an electric motor operably driving the punch;

at least one die supporting member movably mounted to the frame;

at least one die mounted to the die supporting member;

a pivot pin coupled to the die supporting member; and an elongated drive member coupled to the die supporting member at a point offset from the pivot pin;

wherein the die supporting member is movable to a first position in which the die is placed in an opposed and substantially aligned relationship to the punch during fastening operations, and the die supporting member is rotatable to a second position by movement of the drive member in which the die is oriented in an offset manner from the punch, thereby increasing the distance between the die and the punch during non-fastening operations.

2. The rivet setting machine of claim 1, wherein the die supporting member is movably mounted to the frame by the pivot pin.

3. The rivet setting machine of claim 2 further comprising:

a drive unit mounted to the frame;

the drive member is a rod extending from the drive unit and attaching to the die supporting member below a horizontal line intersecting the pivot pin, wherein the drive unit operates to automatically retract and extend the rod, thereby pivoting the die supporting member about the pin between the first position and the second position.

4. The rivet setting machine of claim 1, wherein the die supporting member further comprises a positioning guide that properly positions the die in the first position during fastening operations.

5. The rivet setting machine of claim 1, wherein the die supporting member further has a bottom surface and the frame further has a top surface, and the bottom surface and the top surface are finely finished in order to precisely position the die during fastening operations.

6. The rivet setting machine of claim 1, wherein the die supporting member is adapted to be pivoted over a range of about 90 degrees between the first position and the second position.

7. The rivet setting machine of claim 1, wherein the die supporting member is adapted to be pivoted over a range of about 180 degrees between the first position and the second position.

8. The rivet setting machine of claim 1, wherein the die supporting member has a substantially triangular shape tapering toward the die.

9. The rivet setting machine of claim 1, wherein the frame is C-shaped and the die supporting member is taller in the punch centerline direction than it is wider.

10. The rivet setting machine of claim 1 further comprising a self-piercing rivet operatively advanced by the punch, the punch and die being configured to set the self-piercing rivet.

11. The rivet setting machine of claim 1 further comprising a connecting section mounted to the frame and an articulated robot arm, wherein the connecting section is connected to the articulated robot arm.

12. A rivet setting machine comprising:

at least one punch movable from a retracted position to a rivet advancing position;

a first member movable from a first orientation to a second orientation;

at least one die mounted to the first member, the die being spaced apart a first distance from the punch;

a drive unit; and an elongated second member coupling the drive unit to the first member;

the drive unit being energizable to automatically retract and extend the second member; and the first member being moveable between the first orientation in which the die is placed in an opposed relationship to the punch during fastening operations, and the second orientation in which the die is placed at a position offset from the punch.

13. The rivet setting machine of claim 12, wherein the first member further comprises a positioning guide that properly positions the die in the first orientation during fastening operations.

14. The rivet setting machine of claim 12, wherein the first member is adapted to be pivoted over a range of about 90 degrees between the first orientation and the second orientation.

15. The rivet setting machine of claim 12 further comprising a self-piercing rivet operatively advanced by the drive unit, the punch and die being configured to set the self-piercing rivet.

16. The rivet setting machine of claim 12 further comprising a connecting section mounted to the machine and an articulated robot arm, wherein the connecting section is connected to the articulated robot arm.

17. The rivet setting machine of claim 12, wherein the drive unit further comprises an electromagnetic device.

18. A riveting apparatus comprising:

a substantially C-shaped frame;

at least one punch movably mounted to a first end of the frame;

at least one die supporting member movably mounted to a second end of the frame;

at least one die mounted to the die supporting member; and a pin coupling the die supporting member to the frame, wherein the die supporting member is operatively rotated about the pin to a first position in which the die is placed in an aligned relationship to the punch during fastening operations, and the die supporting member is rotated substantially 180 degrees about the pin to a second position in which the die is placed at a position offset from the punch, thereby increasing the distance between the die and the punch during non-fastening operations.

19. The rivet setting machine of claim 18, wherein the die supporting member further comprises a positioning guide that properly positions the die in the first position during fastening operations.

20. The rivet setting machine of claim 19, wherein the second end of the frame further comprises a depression that receives the positioning guide when the die supporting member is in the first position.

21. The rivet setting machine of claim 18, wherein the die supporting member further comprises a bottom surface and the second end of the frame further comprises a top surface, and the bottom surface and the top surface are finely finished in order to precisely position the die during fastening operations.

22. The rivet setting machine of claim 18, wherein the die supporting member is automatically pivotable about the pin over a range of about 180 degrees between the first position and the second position.

23. The rivet setting machine of claim 22 further comprising:

a drive unit mounted to the frame; and a rod extending from the drive unit and attached to the die supporting member, wherein the drive unit operates to retract and extend the rod, thereby moving the die supporting member about the pin between the first position and the second position.

24. The rivet setting machine of claim 18, wherein the rivet setting machine is self-piercing.

25. The rivet setting machine of claim 18 further comprising a connecting section mounted to the frame and an articulated robot arm, wherein the connecting section is connected to the articulated robot arm.

26. A riveting system comprising:

a frame;

at least one punch movably mounted to the frame;

at least one die supporting member movably mounted to the frame;

at least one die mounted to the die supporting member, the die spaced apart a distance from the punch;

a rivet operably set by the punch and the die; and a rail disposed on the frame, wherein the die supporting member is automatically and slidably moved along the rail to a first position in which the die is placed in an opposed relationship to the punch during fastening operations, and the die supporting member is slidably moved along the rail to a second position in which the die is placed at a position apart from the punch.

27. The riveting system of claim 26, wherein the rail further comprises a positioning guide that properly positions the die in the first position during fastening operations.

28. The riveting system of claim 26 further comprising:

a drive unit mounted to the frame; and a rod extending from the drive unit and attached to the die supporting member, wherein the drive unit operates to retract and extend the rod, thereby moving the die supporting member along the rail between the first position and the second position.

29. The riveting system of claim 26 further comprising an electric motor operably advancing the punch and a rivet, wherein the frame is C-shaped.

30. The riveting system of claim 26, wherein the rivet is a self-piercing rivet.

31. The riveting system of claim 26 further comprising a connecting section mounted to the frame and an articulated robot arm, wherein the connecting section is connected to the articulated robot arm.

32. A method of operating a rivet setting machine having a punch, a die, and a frame, the punch and die being coupled to the frame, the method comprising:

(a) moving the die to a first position relative to the frame such that the die is offset from the punch; and (b) energizing a drive unit and automatically moving the die to a second position such that the die is in a substantially aligned relationship to the punch.

33. The method of claim 32 further comprising pivoting the die between the first and second positions.

34. The method of claim 32 further comprising pivoting the die over a range of about 180 degrees.

35. The method of claim 32 further comprising sliding the die along a rail disposed on the frame.

36. The method of claim 32 further comprising advancing a self-piercing rivet by moving the punch toward the die when the die is in the second position.

37. A method of operating a riveting machine having a punch, a die, and a substantially C-shaped frame, the method comprising:

(a) moving the die to a first position, wherein the die is placed at a position offset from the punch;

(b) providing additional space between the die and the punch to allow insertion of workpieces into the frame;

(c) moving the die to a second position, wherein the die is placed in an opposed relationship to the punch;

(d) driving the punch toward the die to insert a rivet into the workpieces, and self piercing the workpieces with the rivet;

(e) changing energization of an electromagnetic drive unit for moving the die to the first position after step (d); and (f) providing additional space between the die and the punch to allow removal of the fastened workpieces from the frame.

38. The method of claim 37 further comprising pivoting the die over a range of about 90 degrees when the die is moved between the first position and the second position.

39. The method of claim 37 further comprising pivoting the die over a range of about 180 degrees when the die is moved between the first position and the second position.

40. The method of claim 37 further comprising sliding the die along a rail disposed on the frame when the die is moved between the first position and the second position.

* * * * *